US006077174A

United States Patent [19]

Noritake

[11] Patent Number: 6,077,174

[45] Date of Patent: Jun. 20, 2000

[54] GOLF BALL MARKER

[76] Inventor: Hideyuki Noritake, 476-32, Tenma, Chiaki-cho, Ichinomiya-city, Aichi 491-0817, Japan

[21] Appl. No.: 09/168,993

[22] Filed: Oct. 9, 1998

[30] Foreign Application Priority Data

| | | | |
|---|---|---|---|
| Oct. 13, 1997 | [JP] | Japan | 9-279122 |
| Nov. 20, 1997 | [JP] | Japan | 9-320134 |
| Jul. 27, 1998 | [JP] | Japan | 10-211425 |
| Sep. 17, 1998 | [JP] | Japan | 10-263410 |

[51] Int. Cl.[7] ..... A63B 57/00

[52] U.S. Cl. ..... 473/406

[58] Field of Search ..... 473/405, 406, 473/407, 396, 397; D21/793, 794

[56] References Cited

U.S. PATENT DOCUMENTS

| | | | |
|---|---|---|---|
| D. 378,117 | 2/1997 | Aleamoni | D21/793 |
| 1,484,064 | 2/1924 | Erickson et al. | 473/405 |
| 3,575,420 | 4/1971 | Turner | 473/397 |
| 4,645,208 | 2/1987 | Morabeto | 473/397 |
| 5,135,220 | 8/1992 | Baldoni . | |
| 5,282,616 | 2/1994 | Stacavich-Notaro . | |
| 5,476,258 | 12/1995 | Frisone . | |
| 5,795,249 | 8/1998 | Johnson | 473/406 |

FOREIGN PATENT DOCUMENTS

| | | |
|---|---|---|
| 5-168735 | 7/1993 | Japan . |
| 9-271549 | 10/1997 | Japan . |
| 2202752 | 10/1988 | United Kingdom . |

*Primary Examiner*—Steven Wong
*Attorney, Agent, or Firm*—Wenderoth, Lind & Ponack, L.L.P.

[57] ABSTRACT

A golf ball marker is used for marking a golf ball hit onto a putting green and includes a circular base disk and a pin-like embedded portion extending from the base disk and insertable into the green. A standing portion is hingedly mounted on one end of the base disk so as to be rotatable. The standing portion and the base disk engage each other when an engaging protrusion engages an engaged hole. When the marker is far away from a cup on the green, the engagement of the engaging protrusion and the engaged hole is released and the standing portion is raised up. The base disk becomes substantially planar with the putting green, the standing portion is capable of standing at an upper side of the base disk, and the embedded portion extends down from a backside of the base disk so as to be embedded into the green.

14 Claims, 16 Drawing Sheets

GOLF BALL MARKER

BACKGROUND OF THE INVENTION

1. Field of the Invention

This invention relates to a golf ball marker for marking a location of a golf ball on a putting green.

2. Description of the Prior Art

Golf ball markers or coins have conventionally been used to mark a location of a golf ball hit onto a putting green of a golf course. The golf ball markers comprise a circular base disk and a pin extending downward from the base. The conventional golf ball markers and the coins become planar with the green when placed thereon in actual use. Accordingly, when the distance between the ball and the cup exceeds 15 yards, the golf ball marker is integrated with the green such that the player cannot understand the location of the mark. In this case, the player cannot confirm a putting line, viewing the marker from the cup side during putting by other players. As such, when the player's turn comes around he or she replaces the golf ball for the marker and then re-confirms the putting line from the cup side. This results in a waste of time.

Golf players should refrain from the above-mentioned reconfirmation of the putting line in many cases when expeditious play is required. However, it is not always easy for players to putt a long distance without sufficiently confirming the putting line. The mental factor is particularly dominant in the golf. A failure in putting on one hole sometimes adversely affects the mental condition of the player on subsequent holes.

SUMMARY OF THE INVENTION

Therefore, an object of the present invention is to provide a golf ball marker which can be clearly viewed when placed on the green for marking the location of the golf ball.

To achieve the object, the present invention provides a golf ball marker comprising a base disk that becomes substantially planar with a green, a standing portion capable of standing at an upper side of the base disk, and an embedded portion extending from a backside of the base disk so as to be embedded into the green.

According to the above-described marker, the embedded portion thereof is embedded into the green so that the location of the ball is marked. At this time, the standing portion can be caused to stand at the upper side of the base disk. For example, the golf ball marker may be integrated with the green when the player confirms a putting line from the cup side for the reason that the marker is far away from the cup. Even in such a case, the marker of the invention can clearly be distinguished from the green by raising the standing portion.

In a preferred form, the standing portion is formed via a hinge integrally with the base disk so as to be rotatable between a closed position in which the standing portion covers the base disk and a standing position in which the standing portion stands from the base disk. In this construction, the standing portion is formed integrally with the base disk. Consequently, the standing portion can be prevented from being lost.

In another preferred form, at least one of the base disk and the standing portion is provided with an engagement portion for holding the standing portion in a lowered state relative to the base disk. In this construction, when the standing portion is not used, the engagement portion is manipulated so that standing portion and the base disk engage each other with the standing portion having been lowered relative to the base disk. Thus, the usability of the marker can be improved since the standing portion can be caused to stand when necessary. Furthermore, when the base disk and the standing portion are discrete from each other, these members are caused to engage each other, so that only the standing portion can be prevented from being lost.

In further another preferred form, at least one of the base disk and the standing portion is provided with a recess accommodating the other with the standing portion having been lowered relative to the base disk. In this construction, one of the base disk and the standing portion is accommodated in the recess formed in the other when the standing portion is not used. Consequently, the marker can be rendered compact and its usability can be improved.

In another preferred form, the standing portion includes a finger hook provided for standing manipulation at a portion thereof opposite the base disk when having been lowered relative to the base disk. In this construction, a finger is put onto the finger hook when the standing portion, in the lowered state relative to the base disk, is caused to stand. Consequently, the standing portion can easily be manipulated to be moved from the fallen state to the standing state.

BRIEF DESCRIPTION OF THE DRAWINGS

Other objects, features and advantages of the present invention will become clear upon reviewing the following description of the preferred embodiments, made with reference to the accompanying drawings, in which.

DETAILED DESCRIPTION OF THE PREFERRED EMBODIMENTS

Figure 1:
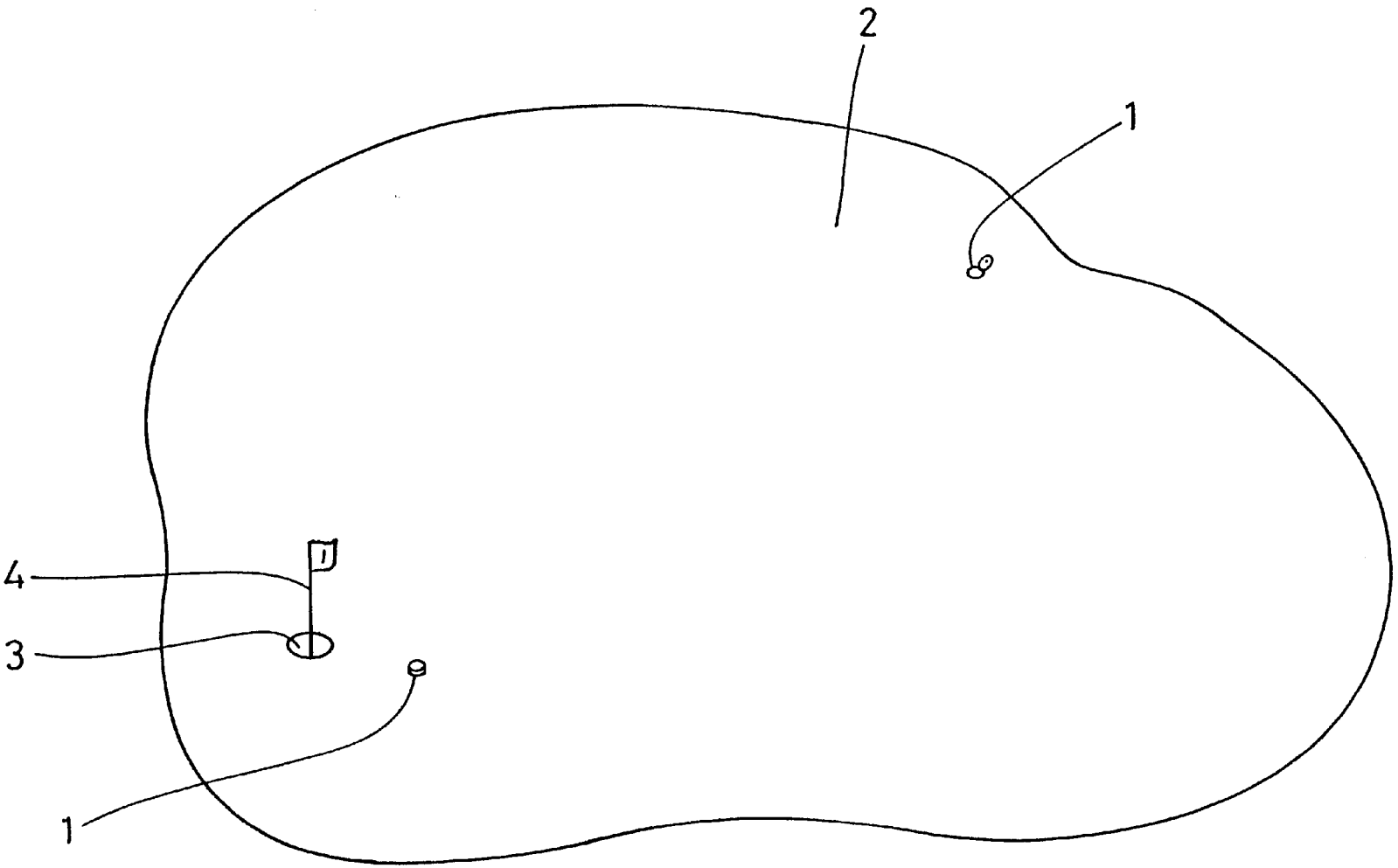
FIG. 1 is a perspective view of a golf ball marker of a first embodiment in accordance with the present invention, showing the marker on the green.

A first embodiment of the present invention will be described with reference to FIGS. 1 to 3. Referring to FIG. 1, a golf ball marker 1 of the embodiment in accordance with the present invention is shown. The marker 1 is located on a putting green 2. A cup 3 is provided in the green 2 on the left as viewed in FIG. 1. A flag 4 stands from the cup 3. Two golf ball markers 1 are embedded in the green 2 in FIG. 1. A standing portion 5 of the right-hand marker 1 located farther away from the cup 3 is raised from the base disk 6, as will be described later.

Figure 2:
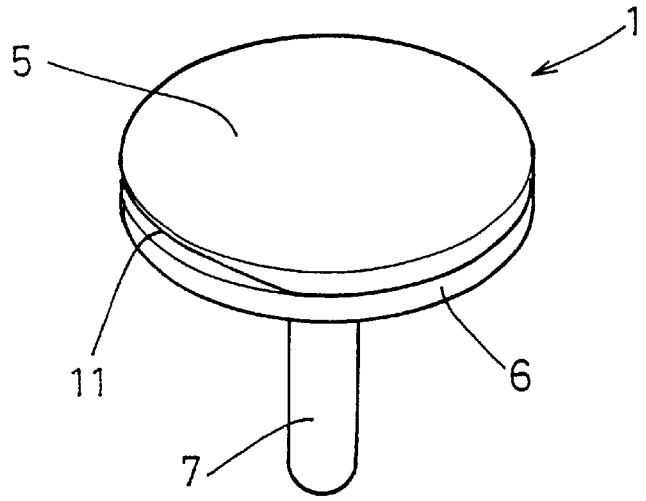
FIG. 2 is a perspective view of the marker assuming a closed position.
Figure 3:
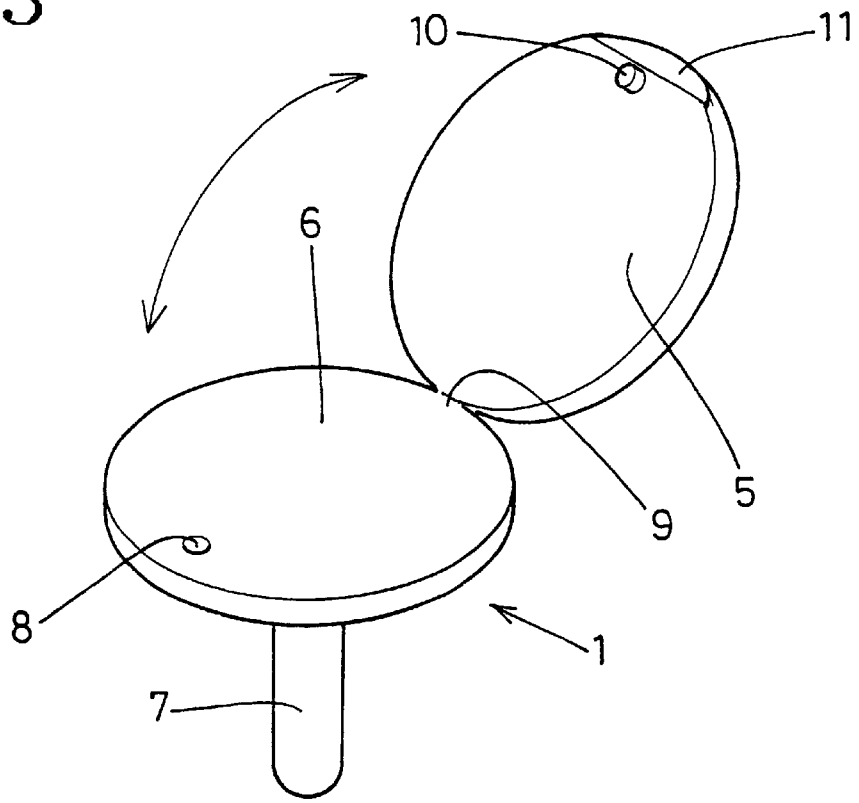
FIG. 3 is a perspective view of the marker assuming a standing position.

Referring to FIG. 2, the marker 1 in its closed state is shown. The marker 1 is integrally made of a synthetic resin and is used to mark a golf ball (not shown) on the green 2 so that a player can see the location of the ball. The marker 1 comprises a circular base disk 6 and an embedded portion 7 extending from the central backside of the base disk 6. Standing portion 5 is connected to one end of the base disk 6.

The base disk 6 has a suitable thickness so as to be substantially planar with the green 2 in use. An engaged hole, 8 serving as an engagement portion in the invention, is formed in a portion slightly inside of an outer edge on the upper side of the base disk 6. The embedded portion 7 has a rounded pin-shaped distal end. The embedded portion 7 is embedded into the green 2 substantially over its entire length.

The standing portion 5 is mounted on a hinge 9 further mounted on the end of the base disk 6 opposite to the engagement hole 8 with respect to the center thereof. The standing portion 5 is formed into the same shape as the base disk 6. The standing portion 5 is thus rotatable via the hinge 9 relative to the base disk 6 so as to be displaced between a closed position in which the standing portion 5 covers the base disk 6 and a standing position in which the standing portion 5 stands from the base disk 6. The standing portion 5 has an engaging protrusion 10 formed on its side opposite to the base disk 6 so as to correspond to the engaged hole 8. The engaging protrusion 10 serves as an engaging portion in the invention. The engaging protrusion 10 has an outer diameter approximately equal to or slightly larger than a diameter of the engaged hole 8 of the base disk 6, so that the engaging protrusion 10 is fitted into the engaged hole 8 with detent. A portion of the standing portion 5, from the engaging protrusion 10 to the distal end thereof, is chamfered into an inclined face so that a finger manipulation portion 11 is provided. When the standing portion 5 assumes the closed position relative to the base disk 6, the finger manipulation portion 11 is located slightly over the base disk 6.

The operation and effects of a golf ball marker 1 will now be described. When a golf ball is hit onto the green 2, the ball is replaced with the marker 1 so that the location of the ball is memorized. The standing portion 5 is maintained at the closed position at which it covers the base disk 6. The upper side of the standing portion 5 is depressed so that the embedded portion 7 is embedded into the green 2. The marker 1 is released from being depressed when the backside of the base disk 6 abuts the green 2. The player then picks the ball up. Upon completion of marking the ball with the marker 1, the player wipes mud etc. adherent to the ball away. Since the players usually play in the order of locations of the golf balls farthest away from the cup 3, the player awaits his or her turn.

In the above-described marking, the standing portion 5 is raised when the player feels that the distance between the ball and the cup 3 is long. More specifically, the player puts his or her finger on the finger manipulated portion 11 after the embedded portion 7 has been embedded into the green 2. Raising the standing portion 5, the player disengages the engaging protrusion 10 from the engaged hole 8 so that the standing portion 5 is rotated about the hinge 9 to assume the standing position. On the other hand, the standing portion 5 is maintained at the closed position when the distance between the ball and the cup 3 is so short that the player can sufficiently view the marker 1 from the cup 3 side. Thereafter, the player awaits his or her turn. Meanwhile, the player confirms the putting line, moving on the green 2. When his or her turn comes around, the player replaces the marker 1 with the golf ball and then putts.

According to the above-described embodiment, the embedded portion 7 of the marker 1 is embedded into the green 2 so that the golf ball is marked. At this time, the standing portion 5 can be raised from the base disk 6 if the player desires. For example, when the player confirms the putting line from the cup 3 side, the marker may be integrated into the green 2 for the reason that the distance between the marker 1 and the cup 3 is long. Even in such case, the marker 1 can clearly be distinguished from the green 2 by raising the standing portion. Furthermore, the putting line can be confirmed from the cup 3 side further away from the marker 1 even during the play by another player. As a result, the play can be expedited.

The standing portion 5 is caused to be lowered relative to the base disk 6, and the engaging protrusion 10 is manipulated to engage the engaged portion 8, when the standing portion 5 is not used. Thus, the standing portion can be raised when necessary. Additionally, since the standing portion 5 and the base disk 6 are integrated together, either one of them can be prevented from being lost from the other during the play.

Furthermore, the finger is put on the finger manipulation portion 11 to raise the standing portion 5 when the standing portion is moved from the closed position to the standing position. Manipulation is thus improved.

Even when the hinge portion 9 is broken such that the standing portion 5 is separated from the base disk 6, only the base disk 6 side can be used as the golf ball marker. Additionally, since the standing portion 5 has the same outer diameter as the base disk 6, neither of them protrudes from the other when the standing portion 5 assumes the closed position. Consequently, the usability of the marker 1 is improved.

In the foregoing embodiment, the embedded portion 7 is first embedded into the green 2 and the standing portion 5 is then raised. However, this order may be reversed: that is, the embedded portion 7 may be embedded into the green 2 after the standing portion 5 has been previously raised to assume the standing position.

Figure 4:
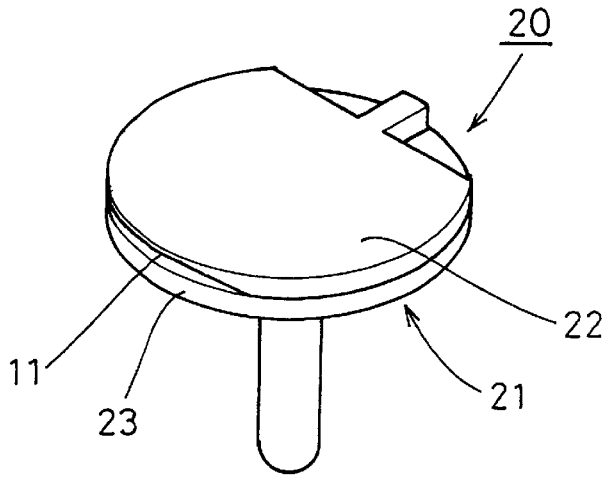
FIG. 4 is a perspective view of a golf ball marker of a second embodiment in accordance with the invention, showing the marker assuming a closed position with a first engagement protrusion engaging an engagement hole.
Figure 5:
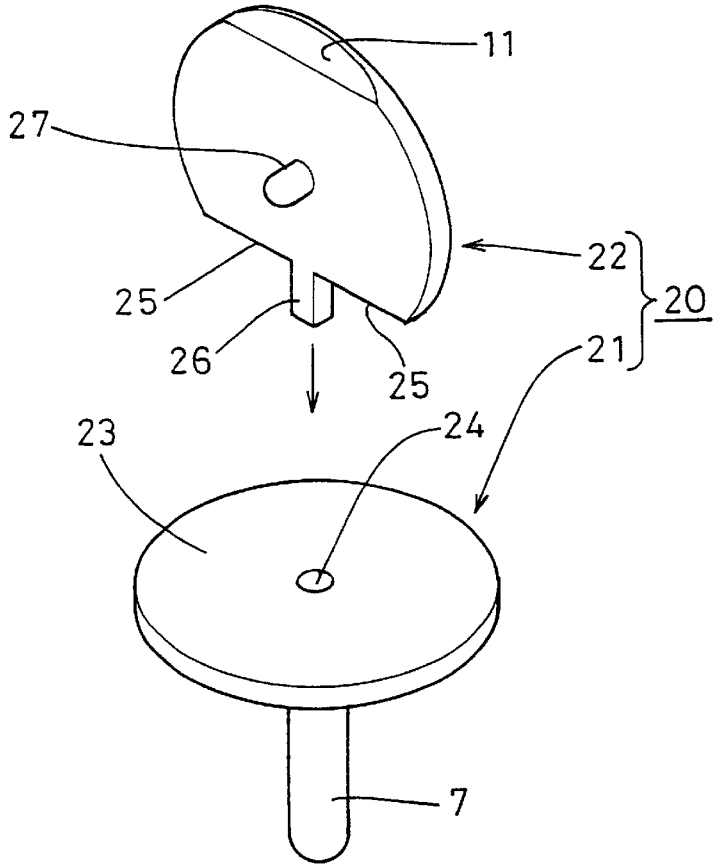
FIG. 5 is a perspective view of a mark portion and standing portion separated from each other.
Figure 6:
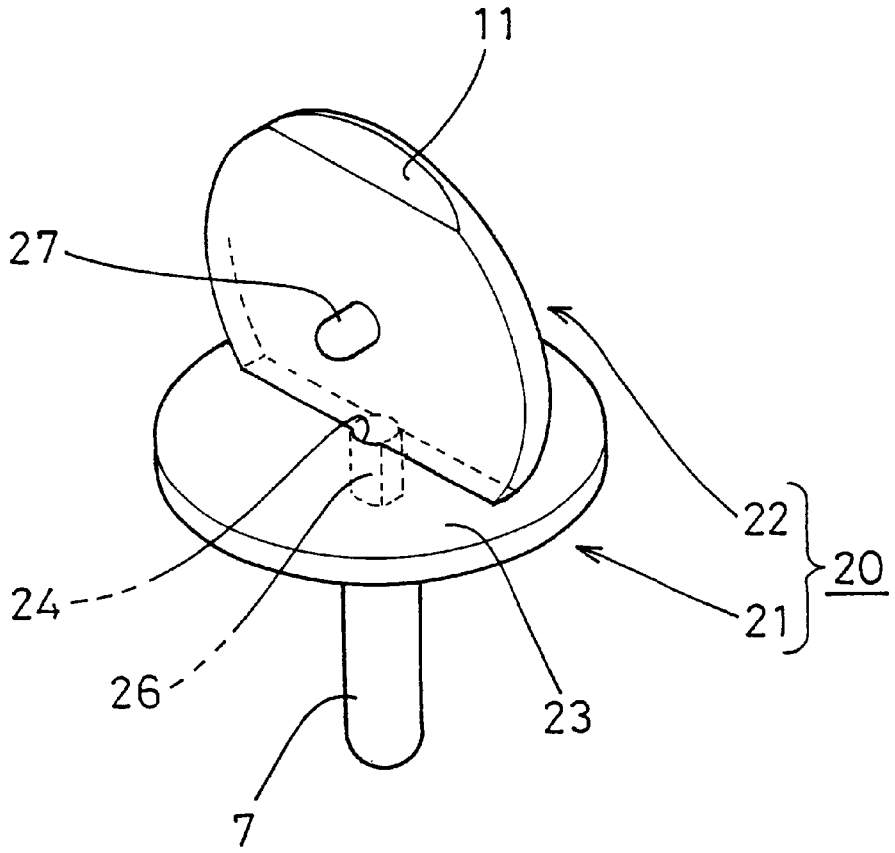
FIG. 6 is a perspective view of a marker assuming the standing position with a second engagement protrusion engaging the engagement hole.

FIGS. 4 to 6 illustrate a second embodiment of the invention. The identical or similar parts in the second embodiment are labeled by the same reference symbols as in the first embodiment and the descriptions of these parts are eliminated. In the second embodiment, the golf ball marker 20 is made of the synthetic resin into a two-piece type. As shown in FIG. 5, a lower portion is a marking portion 21 and an upper portion is a standing portion 22. These portions 21 and 22 are engageable with each other.

The marking portion 21 comprises a circular base disk 23 and the embedded portion 7 extending from the backside of the base disk 23. The base disk 23 has an engaged hole 24 formed in the central upper side thereof. The standing portion 22 is formed into the same disk shape as the marking portion 21. The standing portion 22 has a pair of notches 25 extending inward from one end thereof. A second engaging protrusion 26 is formed between the notches 25 so as to extend radially. The distal end of the second engaging protrusion 26 assumes a position at an outer edge of the standing portion 22 before the forming of the notches 25. The second engaging protrusion 26 is formed into the shape of a square pillar and has an outer diameter equal to or slightly larger than the diameter of the engaged hole 24. A first engaging protrusion 27 protrudes from the central backside of the standing portion 22. The first engaging protrusion 27 has a rounded distal end and is formed into the shape of a square pillar and has a diameter equal to or slightly larger than the diameter of the engaged hole 24. The standing portion 22 has the finger manipulation portion 11 formed on the backside thereof so as to be opposed to the second engaging protrusion 26 with respect to the center thereof.

The marking portion 21 and the standing portion 22 are engaged in a manner as will be described later. The engaged hole of the base disk 23 is engageable with either the engaging portion 26 or 27 of the standing portion 22. When the first engaging protrusion 27 is in engagement with the engaged hole 24, the standing portion 22 assumes the closed position in which the standing portion 22 has been lowered so as to be substantially planar with the base disk 23. On the other hand, when the second engaging protrusion 26 engages the engaged hole 24, the standing portion 22 assumes the standing position in which it stands vertically from the base disk 23.

The standing portion 22 is caused to be lowered into the closed position relative to the marking portion 21 when the marker 1 is not used or when the location of the ball to be marked by the marker 1 is near to the cup 3. Since both members 21 and 22 are integrated, only the standing portion 22 can be prevented from being lost. On the other hand, the standing portion 22 is raised into the standing position when the marker 1 is far away from the cup 3 on the green 2.

The same effects can be achieved in the above-described second embodiment as in the first embodiment.

Figure 7:
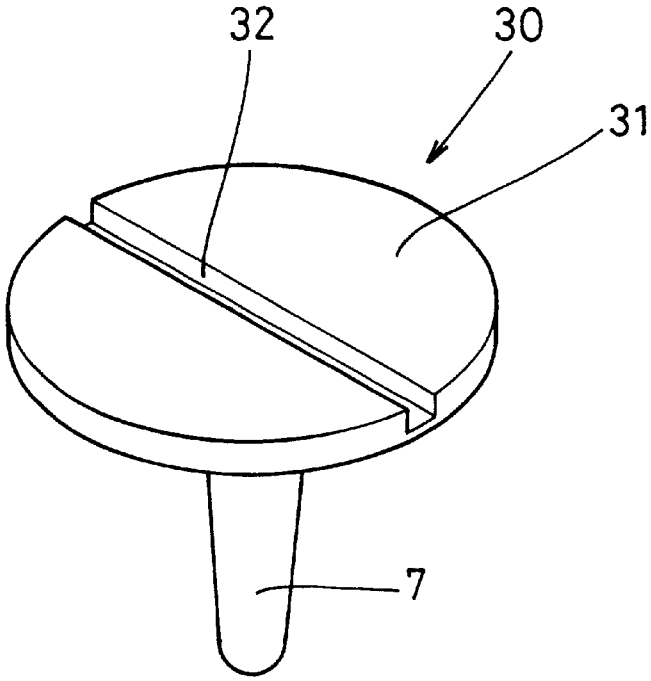
FIG. 7 is a perspective view of a golf ball marker of a third embodiment in accordance with the invention.
Figure 8:
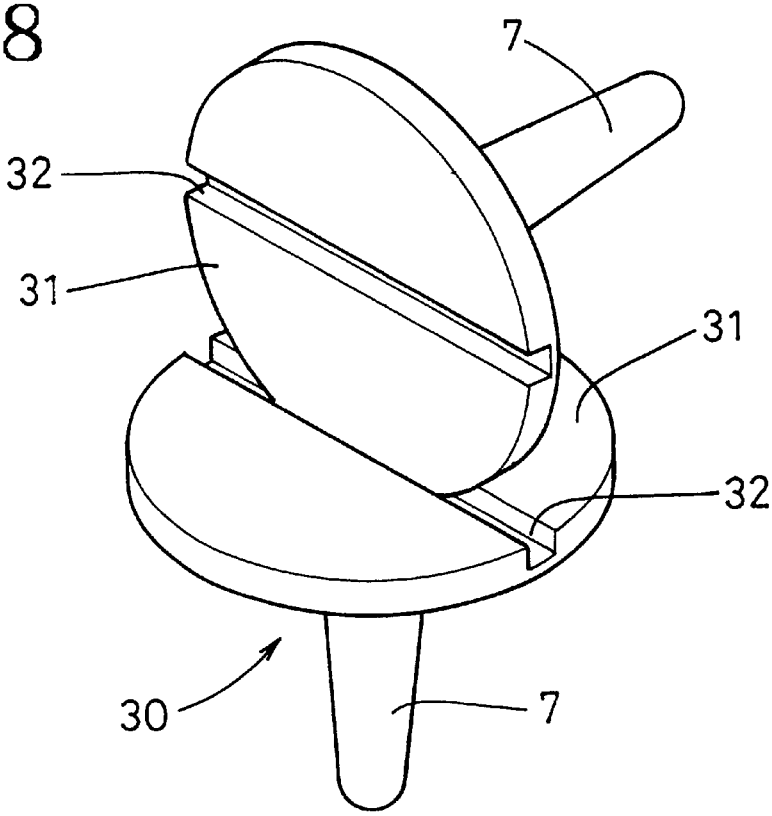
FIG. 8 is a perspective view of two golf ball markers combined with each other.
Figure 9:
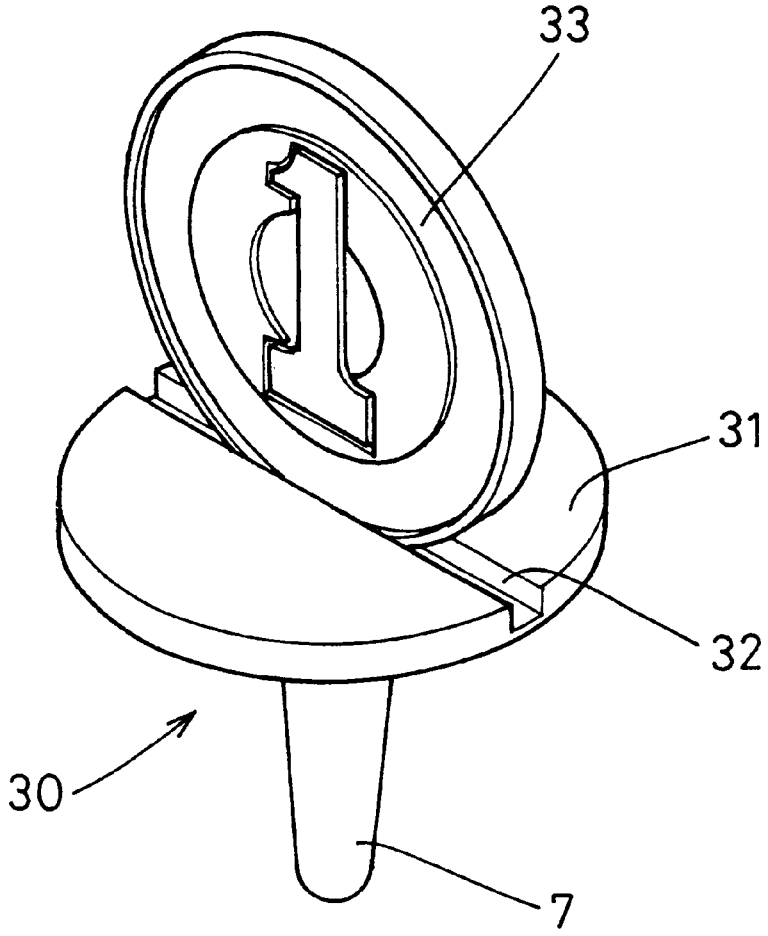
FIG. 9 is a perspective view of the marker combined with a coin.

FIGS. 7 to 9 illustrate a third embodiment of the invention. The identical or similar parts in the third embodiment are labeled by the same reference symbols as in the first embodiment and the descriptions of these parts are eliminated. A golf ball marker 30 of the third embodiment is made of synthetic resin. The base disk 31 has an elongated assembling groove 32 formed in its central upper side so as to cross both ends thereof. The groove 32 has a depth equal to or slightly smaller than the thickness of the base disk 31.

The convenience can be enhanced when the above-described markers 30 are used in a pair. More specifically, the end of the base disk 31 of one marker 30 is inserted into the assembling groove 32 of the other marker 30 so that the base disk 31 of the other marker 30 is used as the standing portion as shown in FIG. 8. Furthermore, when the assembling groove 32 has a width such that a coin 33 can be fitted thereinto, the coin 33 can be used as a standing portion. Although the coin 33 shown in FIG. 9 is a Japanese one-yen coin, other coins, e.g., Japanese five-yen, ten-yen, 50-yen, 100-yen or 500-yen coin, may be used instead.

Figure 10:
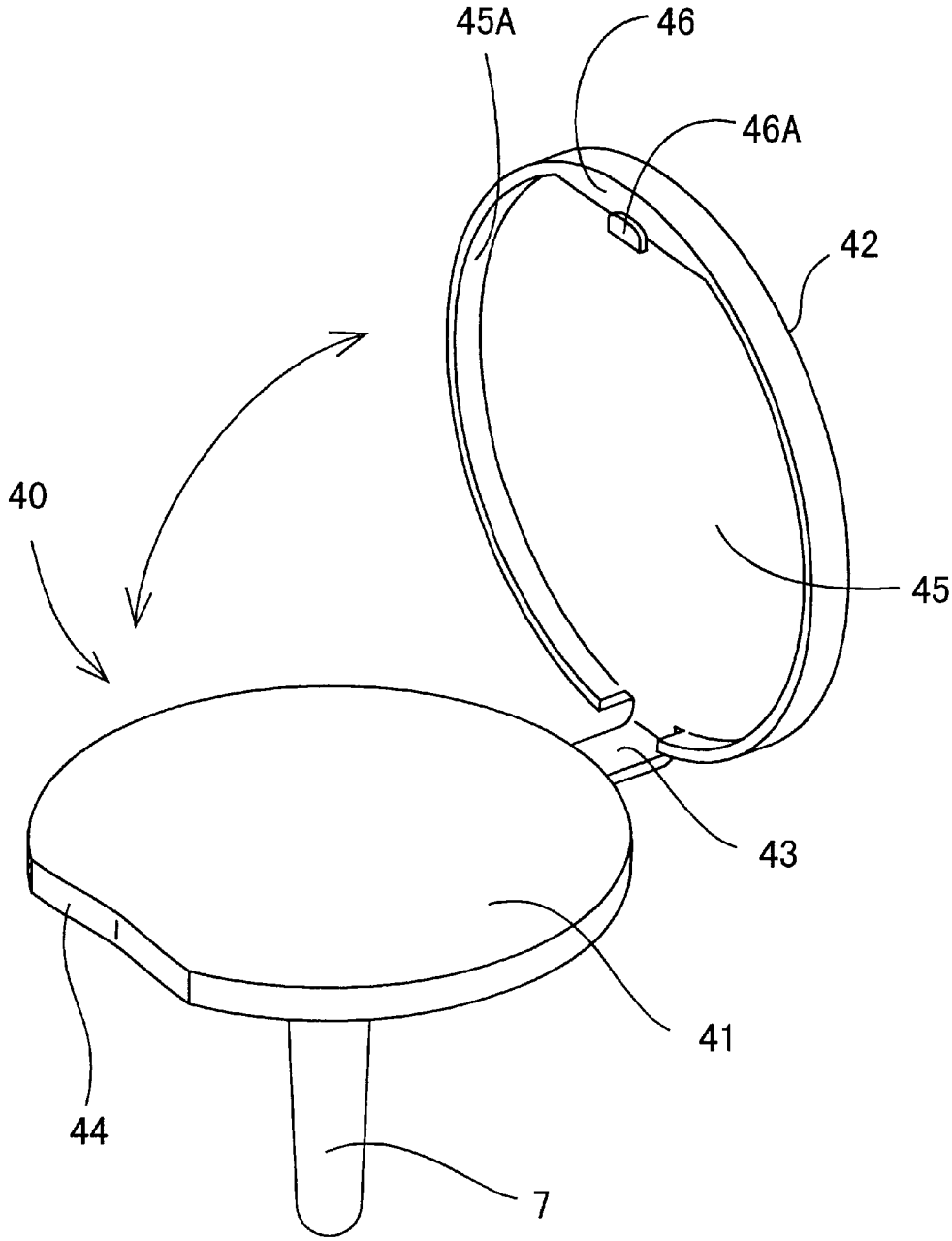
FIG. 10 is a perspective view of a golf ball marker of a fourth embodiment in accordance with the invention.
Figure 11:
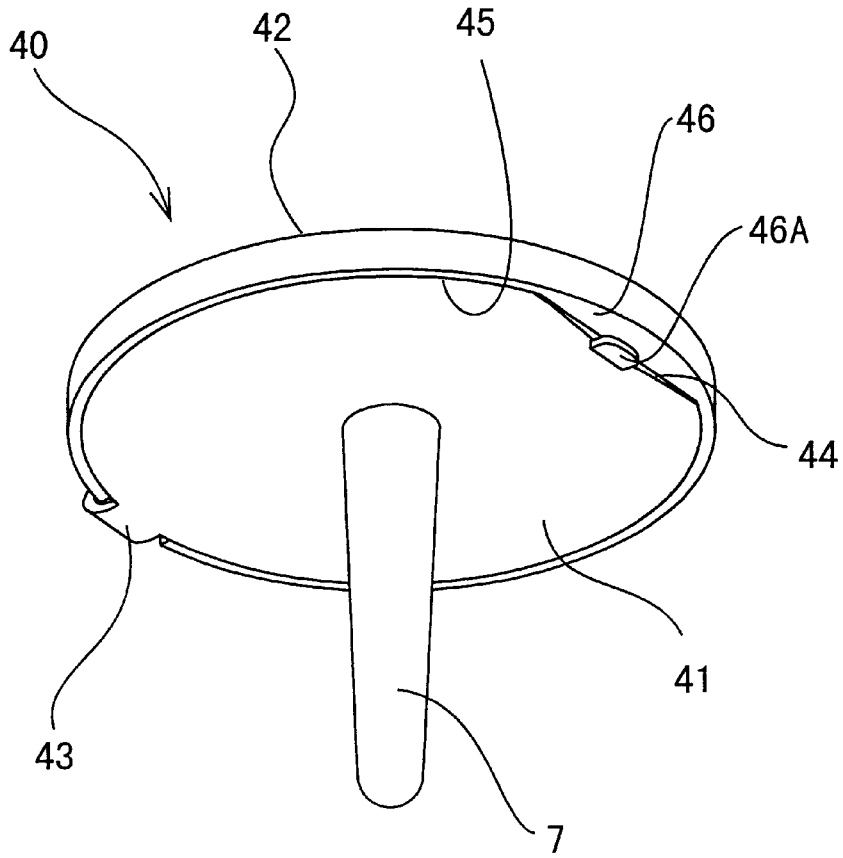
FIG. 11 is a perspective view of a base disk accommodated in a recess.
Figure 12:
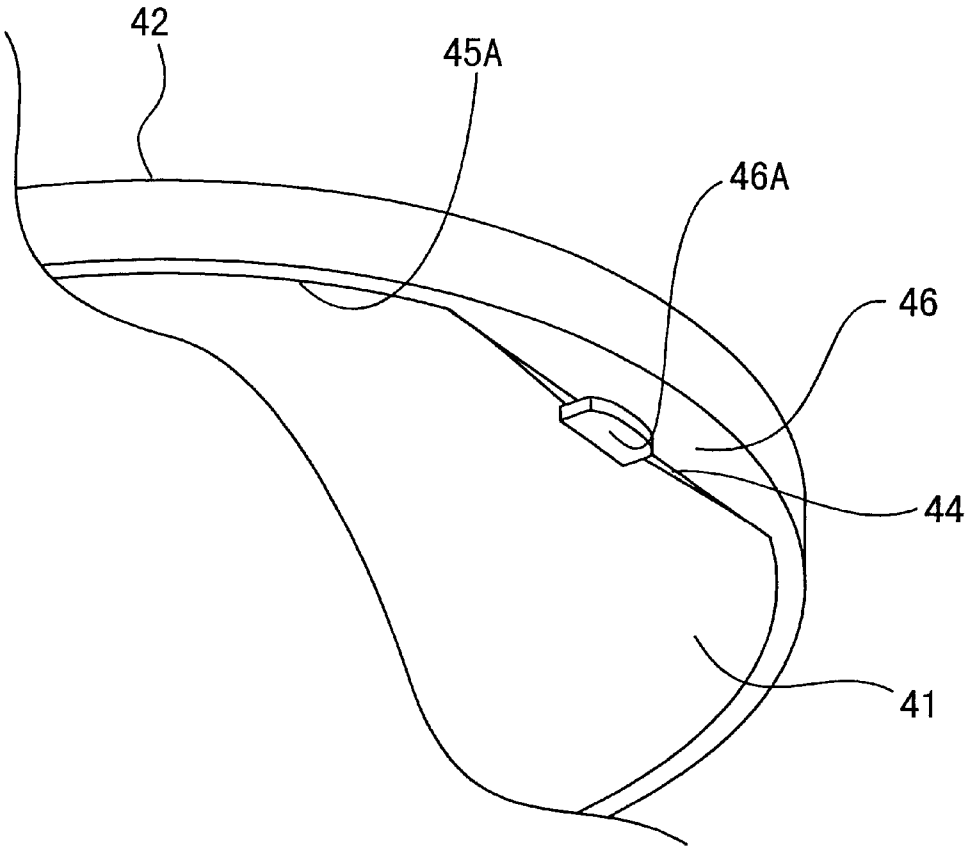
FIG. 12 is a partially enlarged perspective view of a notch and an engagement strip engaging the notch.

FIGS. 10 to 12 illustrate a fourth embodiment of the invention. The identical or similar parts in the fourth embodiment are labeled by the same reference symbols as in the first embodiment and the description of these parts are eliminated. A golf ball marker 40 of the fourth embodiment is integrally made of synthetic resin. The marker 40 comprises a circular base disk 41 and the embedded portion 7 extending from the central backside of the base disk 41. A standing portion 42 is connected via a hinge 43 to one end of the base disk 41. The hinge 43 is flexed so that the standing portion 42 is rotatable relative to the base disk 41. The base disk 41 has a notch 44 formed in the end thereof opposite to the hinge 43.

The standing portion 42 is formed into the shape of a disk of a size larger than the base disk 41. A circumferential all 45A extends cylindrically from the circumferential edge thereof to form a recess 45. The recess 45 has a depth equal to or slightly larger than the thickness of the base disk 41. The recess 45 has an inner diameter equal to or slightly smaller than the diameter of the base disk 41. The recess 45 is formed with a coordinating wall 46 corresponding to a cut-off portion of the notch 44. As a result, the base disk 41 is fitted into the notch 44 with a suitable detent with the notch 44 coordinated by the coordinating wall 46.

The coordinating wall 46 has an engaging claw 46A radially protruding from the central lower end thereof. The engaging claw 46A is engageable with the notch 44. The circumferential wall 45A includes a portion corresponding to the hinge 43 and cut off so as to have a length slightly larger than the width of the hinge 43. Consequently, the base disk 41 is accommodated in the recess 45 and the hinge 43 is adapted to not abut the circumferential wall 45A.

When the standing portion 42 is moved so as to assume the closed position, the base disk 41 is accommodated in the recess 45 with the notch 44 coordinated by the coordinating wall 46. The engaging claw 46A engages the central lower end of the notch 44 so that the base plate 41 engages the recess 45. Furthermore, when the standing portion 42 is moved to the standing position, the finger is put onto the circumferential face 45A near to the portion opposite the hinge 43 so that the player releases the engaging claw 46A from the engagement with the notch 44, raising the standing portion 42. The standing portion 42 is rotated about the hinge 44 to be raised to the standing position.

In the above-described embodiment, the base disk 41 is accommodated in the recess 45 when the standing portion assumes the closed portion. As a result, the marker can be rendered compact. Furthermore, the same effects can be achieved in the fourth embodiment as in the first embodiment.

Figure 13:
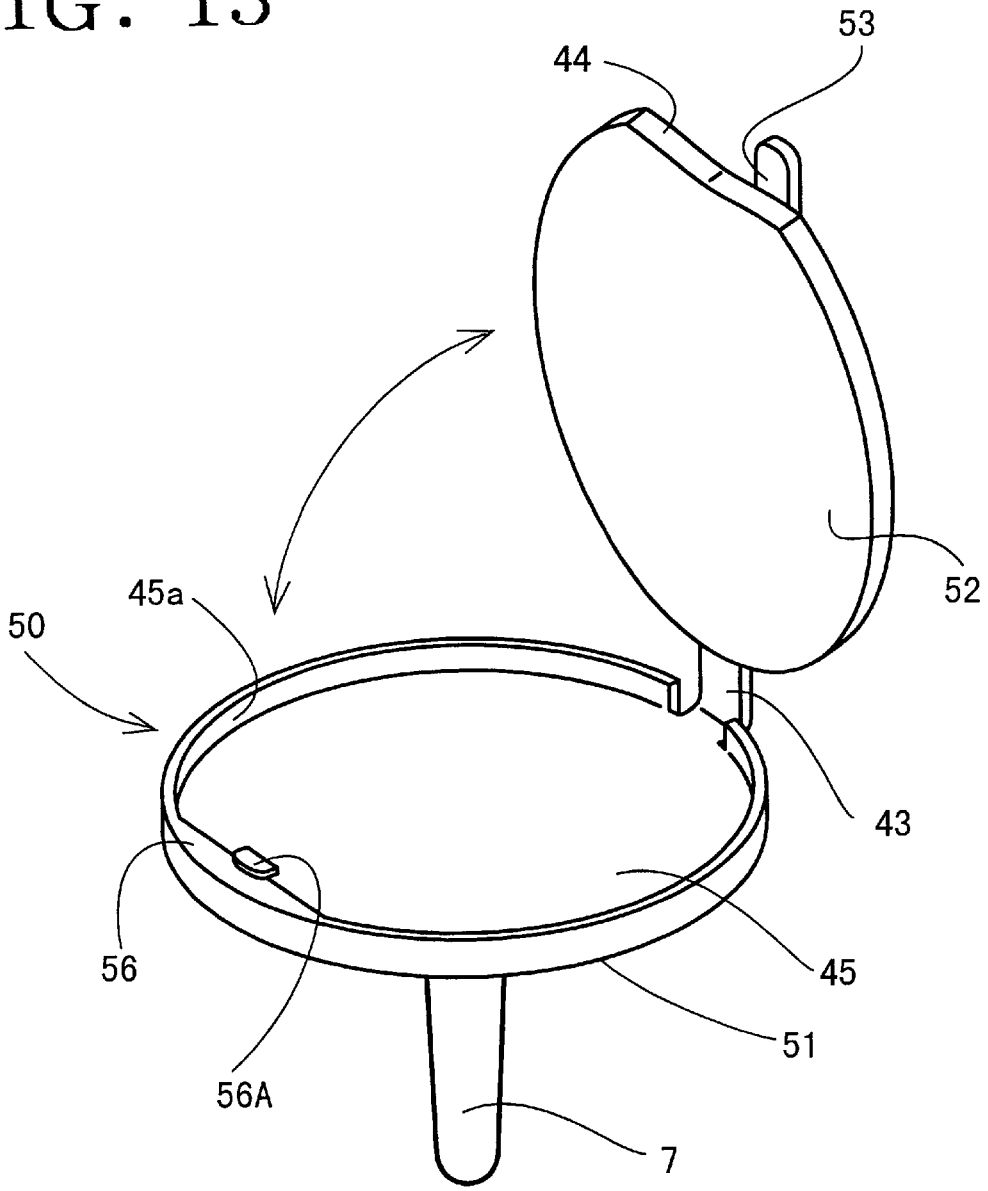
FIG. 13 is a perspective view of a golf ball marker of a fifth embodiment in accordance with the invention.
Figure 14:
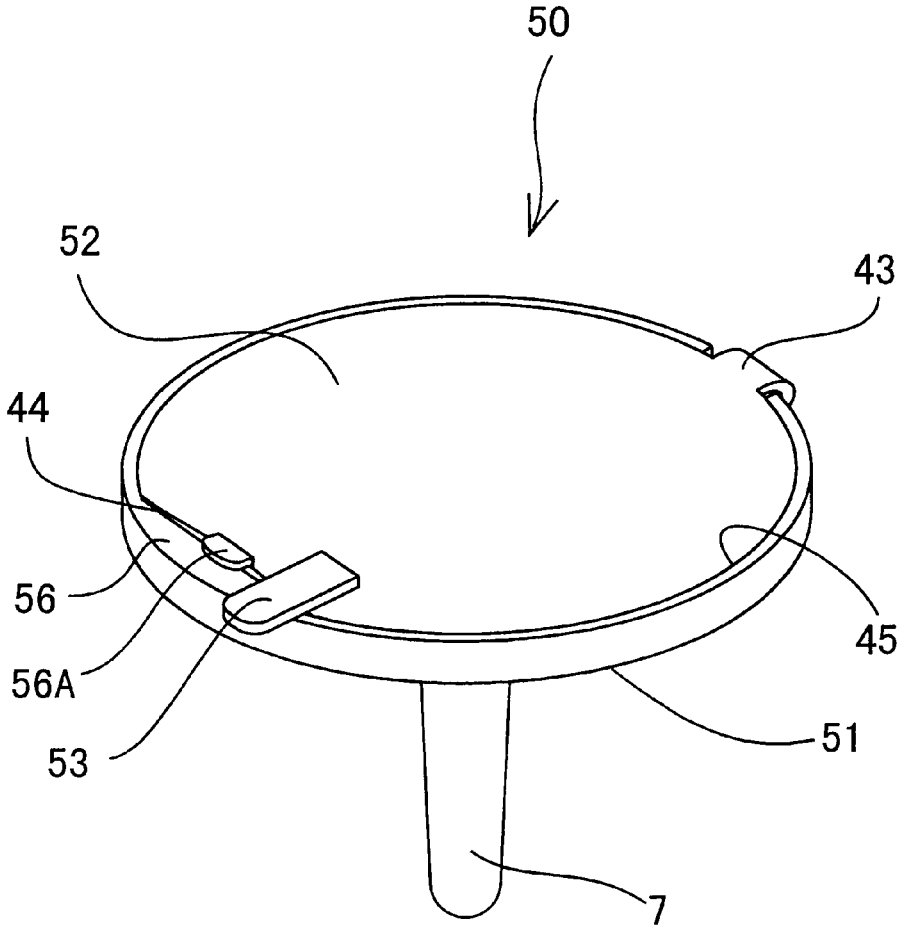
FIG. 14 is a perspective view of the marker with a standing portion being accommodated in a recess.
Figure 15:
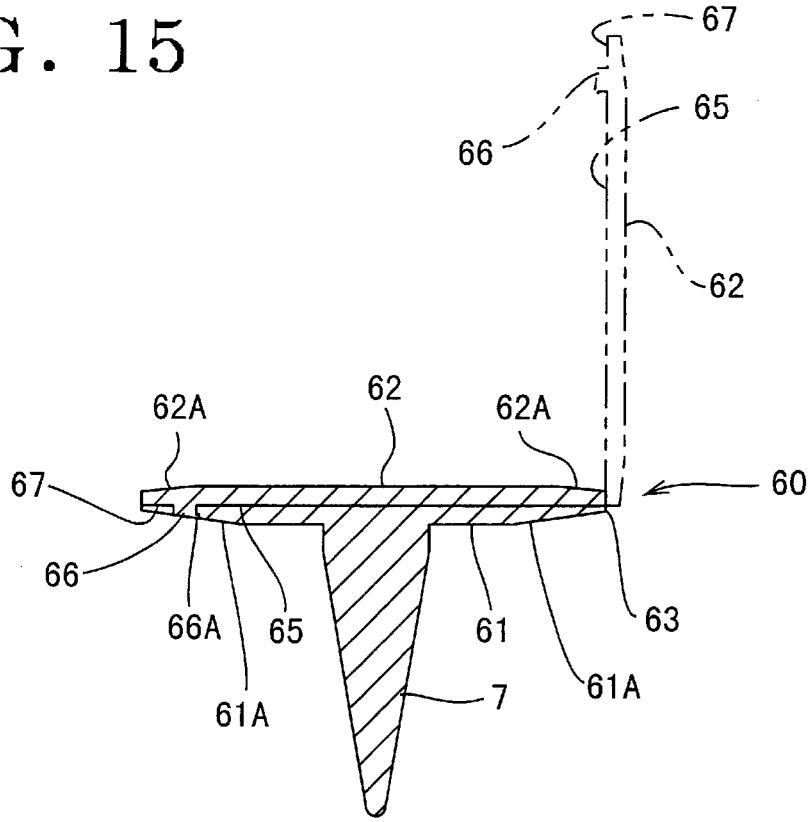
FIG. 15 is a side sectional view of a golf ball marker of a sixth embodiment in accordance with the invention.
Figure 16:
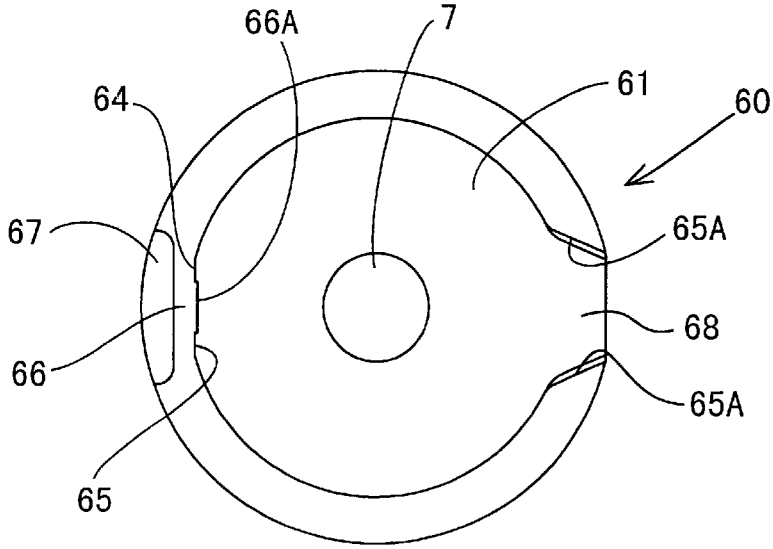
FIG. 16 is a bottom view of the marker.

FIGS. 13 and 14 illustrate a fifth embodiment of the invention. The identical or similar parts in the fifth embodiment are labeled by the same reference symbols as in the first embodiment and the descriptions of these parts are eliminated. In the fifth embodiment, a golf ball marker 50 is integrally made of synthetic resin and comprises a circular base disk 51 having the recess 45 formed in the upper side thereof and the embedded portion 7 extending downward from the central backside of the base disk 51. The recess 45 is formed with a coordinating wall 56 with an engaging claw 56A. A standing portion 52 is connected via the hinge 43 to the base disk 51.

The standing portion 52 is formed into the shape of a disk of a size smaller than the base disk 51. The standing portion 52 has the notch 44 formed in the edge opposite the hinge 43. A circumferential wall 45A extends cylindrically from the circumferential edge of the base disk 51 to be formed into a recess 45. A small strip-like finger manipulation portion 53 protrudes from near the upper side portion of the notch 44 in parallel with a path extending from the hinge 43 through the center of the standing portion 52. The finger manipulation portion 53 has a length such that the distal end thereof protrudes slightly outward from the circumferential wall when the standing portion 52 is accommodated in the recess 45.

The standing portion 52 is accommodated in the recess 45 with the notch 44 in abutment with the wall 56 when the standing portion 52 is caused to assume the closed portion. As a result, the engaging claw 56A engages the central upper end of the notch 44 so that the standing portion 52 engages the recess 45. On the other hand, when the standing portion 52 is raised into the standing position, the finger is put onto the finger manipulation portion 53 to thereby disengage the engaging claw 56A from the notch 44 with the standing portion 52 being raised. The standing portion 52 is then rotated about the hinge 43 to stand at the standing position.

The same effects can be achieved from the fifth embodiment as from the first and fourth embodiments.

FIGS. 15 to 18 illustrate a sixth embodiment of the invention. The identical or similar parts in the sixth embodiment are labeled by the same reference symbols as in the first embodiment and the descriptions of these parts are eliminated. In the sixth embodiment, a golf ball marker 60 is integrally made of synthetic resin and comprises a circular base disk 61 and the embedded portion 7 extending downward from the central backside of the base disk 61. A standing portion 62 is connected to one end of the base disk 61. Connections of the members 61 and 62 are cut so that a hinge 63 is formed. The standing portion 62 is folded back about the hinge 63 so as to be rotatable relative to the base disk 61. A trapezoidal connecting portion 68 extends radially outward at a portion of the base disk 61 connected to the standing portion 62. The hinge 63 is provided at the distal end of the connecting portion 68. The base disk 61 has a notch 64 formed in the end thereof opposite to the hinge 63.

The standing portion 62 is formed into the shape of a disc larger than the base disk 61. The standing portion 62 has a base disk accommodating portion 65 formed in one side thereof. The accommodating portion 65 is capable of accommodating the base disk 61. The accommodating portion 65 is provided with a cut portion 65A capable of accommodating the connecting portion 68. The cut portion 65A prevents the abutment of the base disk 61 and the standing portion 62 when the base disk 61 is accommodated in the accommodating portion 65. The accommodating portion 65 has a coordinating wall 66 formed to correspond to the notch 64. The base disk 61 is fitted into the accommodating portion 65 with a suitable detent with the notch 64 and the wall 66 interfacing each other.

The wall 66 has an engaging claw 66A formed on the central lower end thereof so as to protrude to the accommodating portion 65 side. The claw 66A is engageable with the backside of the notch 64. The wall 66 further has a finger manipulation portion 67 formed near the outer edge of the wall 66 for releasing the engagement of the standing portion 62 and the base disk 61.

Inclined faces 61A and 62A are provided near the outer edges of the base disk 61 and the standing portion 62 respectively. The inclined faces 61A and 62A become thinner as toward the outer edges of the base disk 61 and the standing portion 62 respectively when the marker 60 is viewed from its side.

The same effects can be achieved from the sixth embodiment as from the first and fourth embodiments. Furthermore, the hinge 63 is prevented from protruding out of the outer edge of the marker 60. Accordingly, even when the marker 60 is carried in a pocket etc., it can be prevented from being caught by other things and can be put into and taken out of the pocket etc. smoothly.

The base disk 61 has a smaller diameter than the standing portion 62 so that the accommodating portion 65 is formed spaced from the outer edge of the standing portion 62. Accordingly, even when the base disk 61 and the standing portion 62 are rendered thinner as a result of the provision of the inclined faces 61A and 62A, the thicknesses of these members 61 and 62 required for the engagement can be ensured. Thus, the provision of the inclined faces 61A and 62A renders the marker 60 thinner, so that the marker can be prevented from rising from the green 2 in the closed state.

Figure 17:
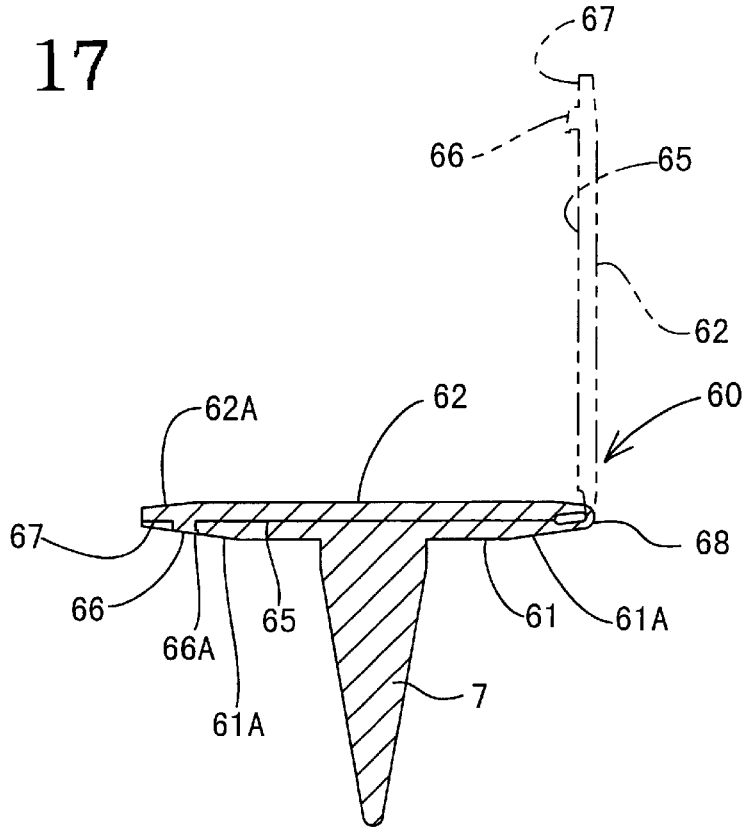
FIG. 17 is a side sectional view of a golf ball marker of a modified form of the sixth embodiment.
Figure 18:
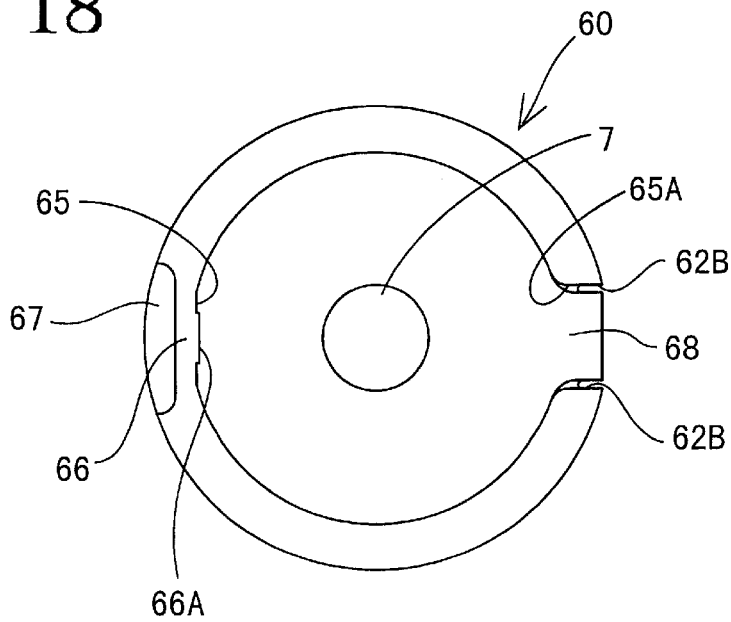
FIG. 18 is a bottom view of the marker of the modified form.

FIGS. 17 and 18 illustrate a modified form of the sixth embodiment. In the modified form, the connecting portion 68 has a uniform width and the cut portion 65A is formed according to the uniform width of the connecting portion 68. The standing portion 62 has a pair of hinge forming recesses 62B formed in the portions thereof connected by the connecting portion 68 so as to correspond to opposite ends of the portion 68 and extend toward the center thereof. The provision of the recesses permits the connecting portion 68 to flex like a hinge.

Figure 19:
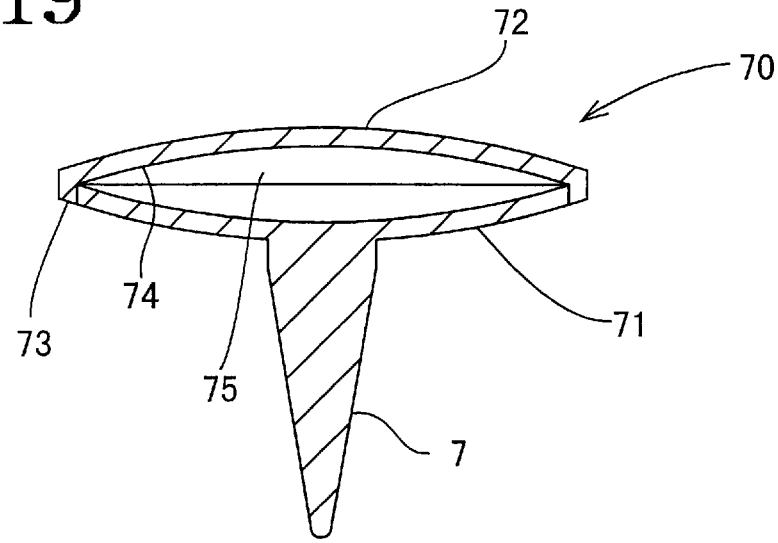
FIG. 19 is a side sectional view of a golf ball marker of a seventh embodiment in accordance with the invention.
Figure 20:
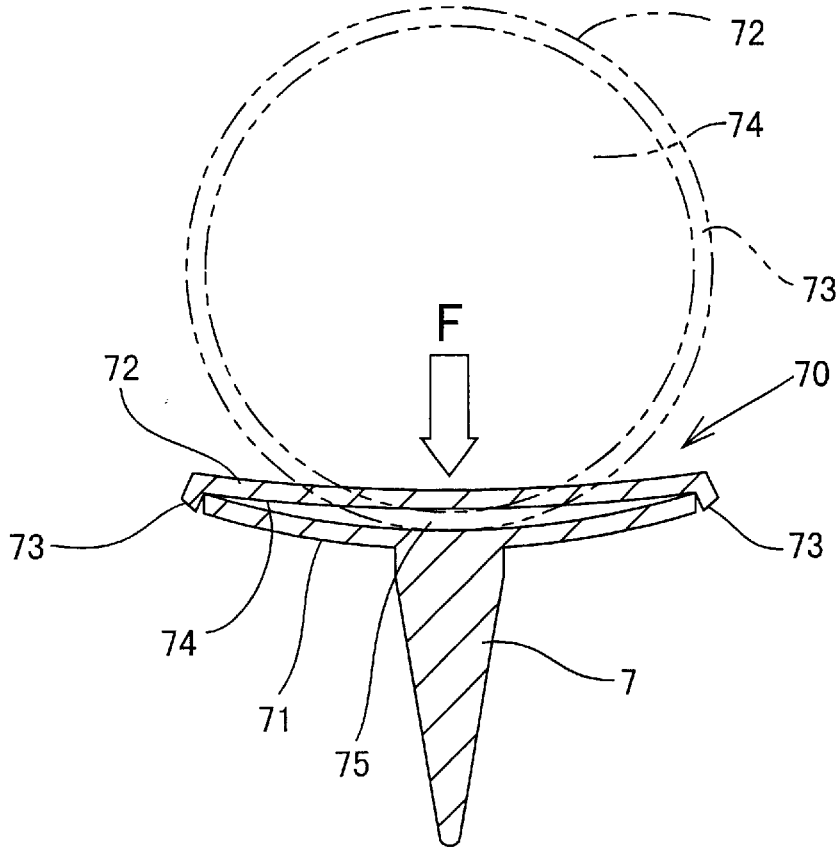
FIG. 20 is also a side sectional view of the marker when the standing portion has been depressed.

FIGS. 19 and 20 illustrate a seventh embodiment of the invention. The identical or similar parts in the seventh embodiment are labeled by the same reference symbols as in the first embodiment and the description of these parts are eliminated. In the seventh embodiment, a golf ball marker 70 is integrally made of synthetic resin and comprises a base disk 71 and the embedded portion 7 extending downward from the central backside of the base disk 71. The base disk 71 is upwardly flexed gently as it goes nearer the outer edge thereof with its center as a lowermost point, so that the base disk is formed into the shape of a saucer. The overall base disk 71 is slightly flexible. The standing portion 72 is connected via the hinge (not shown) to one end of the base disk 71 so as to be rotatable relative to the base disk. The hinge usually urges the standing portion 72 toward the standing position. An engagement portion, which is the same as employed in the fourth embodiment, is provided between the base disk 71 and the standing portion 72, although it is not shown. An engaging force between the base disk 71 and the standing portion 72 when the standing portion 72 assumes the standing position is set to be larger than the urging force of the hinge.

The standing portion 72 is formed into the shape of a disk which of a size larger than the base disk 71 and has a circumferential wall 73 extending cylindrically from the circumferential edge thereof. A recess 74 is defined by the standing portion 72 and the circumferential wall 73. The recess 74 has a diameter approximately equal to the outer diameter of the base disk 71. The recess 74 accommodates the base disk 71. The standing portion 72 is downwardly flexed gently as it goes nearer the outer edge thereof with its center as an uppermost point, so that the standing portion is formed into the shape of an inverted saucer. The standing portion 72 can be flexibly deformed into an inverted state, that is, the outer edge thereof is flexed upward with its center as the lowermost point.

A flexing space 75 is defined by the standing portion 72 and the base disk 71 when the standing portion assumes the closing position. When the standing portion 72 is depressed to the base disk 71 side while assuming the standing position as shown by arrow F in FIG. 20, the overall standing portion is flexibly deformed so that the standing portion is disengaged from the base disk. When the standing portion 72 is quickly released from the depression in this state, the urging force of the hinge rotates the standing portion 72 to the standing position.

The engagement portions of the standing portion 72 and the base disk 71 abut each other when the standing portion assuming the standing position has been depressed to be rotated toward the closed position. When further depressed, the standing portion 72 is slightly flexed, thereby being pushed into the base disk 71 side. Consequently, the base disk 71 is accommodated in the recess 74. When the standing portion 72 is then released from the depressing, the engagement between the engagement portions holds the standing portion 72 at the closed position.

According to the seventh embodiment, the standing portion 72 is displaced between the closed and standing positions when depressed on its upper side. Consequently, the operability of the marker can be improved.

Figure 21:
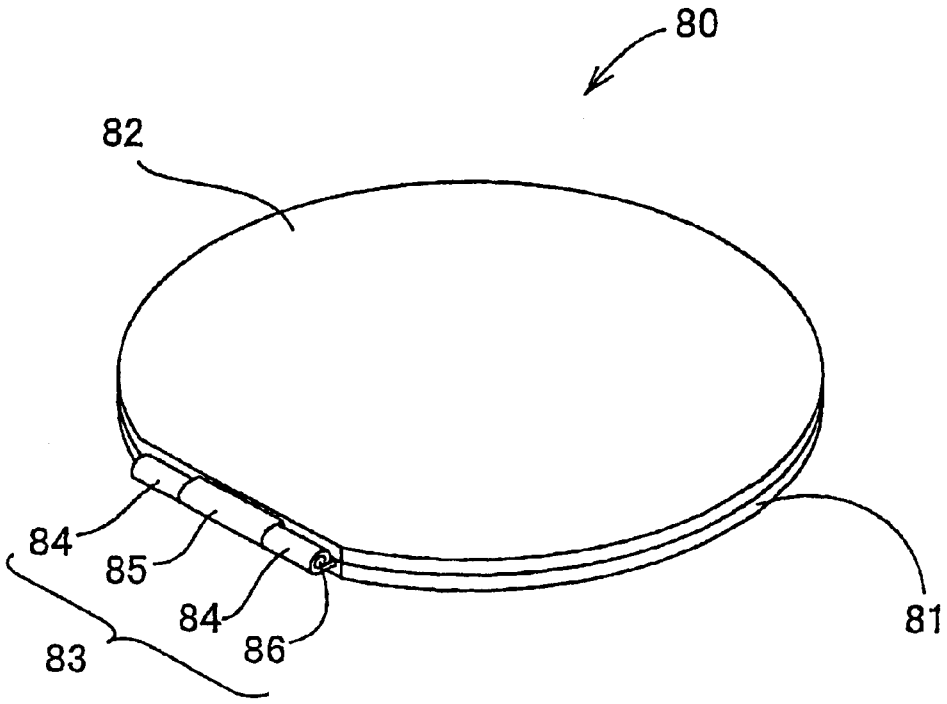
FIG. 21 is a perspective view of a golf ball marker of an eighth embodiment in accordance with the invention, showing a standing portion assuming a closed position.
Figure 22:
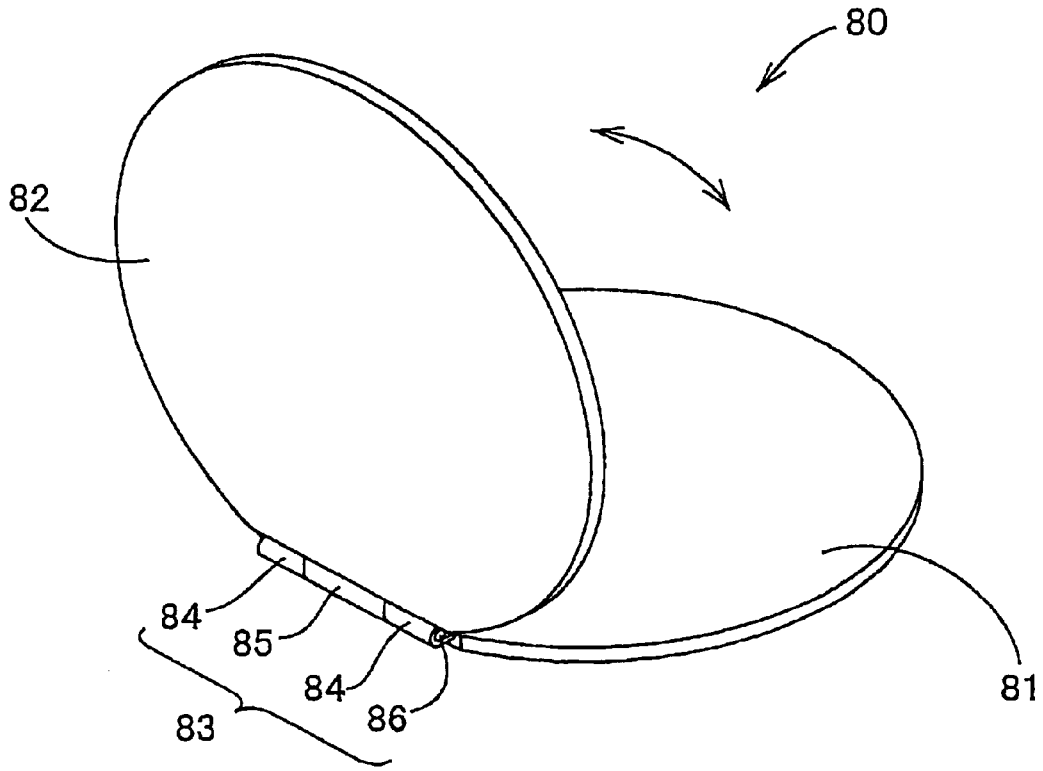
FIG. 22 is a perspective view of the marker showing the standing portion assuming a standing position.

FIGS. 21 and 22 illustrate an eighth embodiment of the invention. A golf ball marker 80 of the eighth embodiment comprises a circular base disk 81 made of metal and a standing portion 82 made of the same metal as the base disk and formed into substantially the same shape as the base disk. A hinge 83 connects between one end of the standing portion 82 and one end of the base disk 81.

The hinge 83 includes a pair of small strips 84 extending from the base disk 81 and a small strip 85 extending from the standing portion 82, both annularly bent so as to be wound on a hinge pin 86. The base disk 81 and the standing portion 82 are rotatable about the hinge pin 86 relative to each other with a suitable resistance force.

The base disk 81 and the standing portion 82 overlap each other when the standing portion assumes the closed position, as shown in FIG. 21. The marker 80 is placed on the green in this state. Furthermore, when the standing portion 82 is displaced to the standing position, the finger is put on the end of the standing portion opposite the hinge 83 with the base disk 81 being held, so that the standing portion is raised as shown in FIG. 22. The standing portion 82 is held at the standing position by the resistance of the hinge 83. In the eighth embodiment, the overall marker is rendered disk-shaped and has less protruding portions when the standing portion 82 assumes the closed position. Consequently, the portability of the marker can be improved as compared with the case where the embedded portion extends from the base disk.

The invention may be modified as follows. Although the base disk is circular in the foregoing embodiments, it may be polygonal, more specifically, triangular or square, elliptic, or star-shaped. Furthermore, the location of the marker can become more distinct when a reflecting mirror is mounted on a junction. Although the markers of the first to eighth embodiments are made of synthetic resin, they may be made of a metal, instead. Alternatively, only the base disk and the embedded portion may be made of the synthetic resin, while the standing portion may be made of the metal. The locations of the engaging protrusions and the engaged holes both serving as the engagement portions should not be limited to those described above. The engaging protrusion may be formed on the base disk and the engaged hole may be formed in the standing portion, instead. Moreover, the engagement portions should not be limited to the protrusion and the hole. The engagement portions may be a hook and an aperture. Additionally, the marker may be provided with positioning means for positioning the standing portion and the base disk when the standing portion assuming the standing position becomes vertical relative to the base disk.

The foregoing description and drawings are merely illustrative of the principles of the present invention and are not to be construed in a limiting sense. Various changes and modifications will become apparent to those of ordinary skill in the art. All such changes and modifications are seen to fall within the scope of the present invention as defined by the appended claims.

What is claimed is:

1. A golf ball marker comprising:

a base disk capable of becoming substantially planar with a putting green, said base disk having an upper side and a back side;

a standing portion capable of standing at said upper side of said base disk;

an embedding portion extending from said back side of said base disk and capable of being embedded into the putting green; and a hinge through which said standing portion is integrally formed with said base disk so as to be rotatable between a closed position in which said standing portion covers said base disk and a standing position in which said standing portion stands from said base disk.

2. The golf ball marker of claim 1, wherein at least one of said base disk and said standing portion comprises an engagement portion for holding said standing portion in a lowered position relative to said base disk.

3. The golf ball marker of claim 1, wherein one of said base disk and said standing portion comprises a recess which accommodates the other of said base disk and said standing portion when said standing portion is in a lowered position relative to said base disk.

4. The golf ball marker of claim 2, wherein one of said base disk and said standing portion comprises a recess which accommodates the other of said base disk and said standing portion when said standing portion is in a lowered position relative to said base disk.

5. The golf ball marker of claim 1, wherein said standing portion comprises a finger manipulation portion for manipulation of said standing portion into said standing position.

6. The golf ball marker of claim 2, wherein said standing portion comprises a finger manipulation portion for manipulation of said standing portion into said standing position.

7. The golf ball marker of claim 5, wherein one of said base disk and said standing portion comprises a recess which accommodates the other of said base disk and said standing portion when said standing portion is in a lowered position relative to said base disk.

8. The golf ball marker of claim 4, wherein said standing portion comprises a finger manipulation portion for manipulation of said standing portion into said standing position.

9. A golf ball marker comprising:

a base disk capable of becoming substantially planar with a putting green, said base disk having an upper side and a back side;

a standing portion capable of standing at said upper side of said base disk;

an embedding portion extending from said back side of said base disk and capable of being embedded into the putting green; and an engagement portion provided with at least one of said base disk and said standing portion for holding said standing portion in a lowered position relative to said base disk.

10. The golf ball marker of claim 9, wherein one of said base disk and said standing portion comprises a recess which accommodates the other of said base disk and said standing portion when said standing portion is in a lowered position relative to said base disk.

11. The golf ball marker of claim 9, wherein said standing portion comprises a finger manipulation portion for manipulation of said standing portion into said standing position.

12. The golf ball marker of claim 11, wherein one of said base disk and said standing portion comprises a recess which accommodates the other of said base disk and said standing portion when said standing portion is in a lowered position relative to said base disk.

13. A golf ball marker comprising:

a base disk capable of becoming substantially planar with a putting green, said base disk having an upper side and a back side;

a standing portion capable of standing at said upper side of said base disk;

an embedding portion extending from said back side of said base disk and capable of being embedded into the putting green; and a recess provided with one of said base disk and said standing portion which accommodates the other of said base disk and said standing portion when said standing portion is in a lowered position relative to said base disk.

14. The golf ball marker of claim 13, wherein said standing portion comprises a finger manipulation portion for manipulation of said standing portion into said standing position.

* * * * *